United States Patent [19]

Powell

[11] 4,375,959

[45] Mar. 8, 1983

[54] WASTE HEAT RECOVERY IN ASPHALT MIXING PLANT

[75] Inventor: Roger A. Powell, Norristown, Pa.

[73] Assignee: The McCarter Corporation, Norristown, Pa.

[21] Appl. No.: 197,649

[22] Filed: Oct. 16, 1980

[51] Int. Cl.[3] ..... F26B 3/20

[52] U.S. Cl. ..... 432/223; 34/35; 34/86; 34/138; 34/75; 110/224

[58] Field of Search ..... 432/105, 106, 223; 34/35, 86, 134, 177, 75, 79, 167, 138; 165/DIG. 2, 179; 110/224

[56] References Cited

U.S. PATENT DOCUMENTS

| | | | |
|---|---|---|---|
| Re. 29,496 | 12/1977 | Dydzyk | 366/25 |
| 1,763,538 | 6/1930 | Randolph | 34/177 |
| 2,244,800 | 6/1941 | Pascale | 165/179 |
| 2,622,342 | 12/1952 | Gouldones et al. | 34/86 |
| 3,131,035 | 4/1964 | Erickson | 34/77 |
| 3,266,166 | 8/1966 | Fuhring | 34/75 |
| 3,482,824 | 12/1969 | Lehman et al. | 259/148 |
| 3,885,908 | 5/1975 | Nagoya et al. | 432/223 |
| 4,165,184 | 8/1979 | Schlarmann | 366/12 |
| 4,190,370 | 2/1980 | Brock et al. | 366/25 |

OTHER PUBLICATIONS

"Heating and Drying of Aggregate — Capture of Waste Heat", Report by National Asphalt Pavement Association, Publication date unknown.

*Primary Examiner*—Larry I. Schwartz
*Attorney, Agent, or Firm*—Howson and Howson

[57] ABSTRACT

In an asphalt mixing plant, a portion of the heat used to vaporize water in the process of drying aggregate is recovered by conducting dryer exhaust gases through parallel ducts which extend serially through the aggregate cold feed bins. These parallel ducts are vertically elongated for optimum heat transfer and to avoid impeding aggregated flow. The ducts have vertically extending external fins for greater contact with the aggregate in the bins. They also have horizontally extending internal fins for improved heat transfer between the exhaust gases and the ducts. The ducts are peaked, and conforming protective caps are provided to prevent damage to the ducts during loading of the bins. Water injection is used to initiate condensation of water vapor in the exhaust gases.

23 Claims, 5 Drawing Figures

WASTE HEAT RECOVERY IN ASPHALT MIXING PLANT

BRIEF SUMMARY OF THE INVENTION

This invention relates to an apparatus and method for the recovery of waste heat in asphalt mixing plants.

In conventional plants for making asphaltic concrete paving materials, a stone aggregate is combined and mixed with liquid asphalt cement to produce a paving material. To achieve a good mixing and coating action and to provide the final product with good compaction properties, the aggregate is dried and heated before it is brought into contact with the liquid asphalt. The drying and heating of aggregate consumes a major part of the energy required in an asphalt plant.

There are two basic types of asphalt plants, the batch process plant and the drum-mix plant. In the batch process, aggregate is typically dried by the application of heat to the aggregate as it passes through a drum rotating on an inclined axis. The hot, dry aggregate is then transferred to a pug mill, in which it is mixed with asphaltic cement. In a drum-mix plant, a single rotating durm is used to effect both drying and mixing. Drying of the aggregate is carried out in a first section of the drum. The aggregate then passes around a heat shield into a mixing section where it is combined with asphaltic cement.

In either type of plant, the drying of an aggregate having a typical moisture content of 5% requires approximately 250,000 BTUs per ton of asphaltic mix produced. Typically, approximately 30 to 45% to this heat is used to vaporize the water in the aggregate. The remaining heat serves to raise the temperature of the stone. In a conventional plant, the combustion products from the dryer or from the drying section of a drum mixer are exhausted to the atmosphere. When the exhaust gases come into contact with the cooler atmosphere, the water vapor content of the exhaust condenses. The condensation process liberates heat. However, the condensation of water vapor in the exhaust gases merely heats up the atmosphere and produces no useful result. Consequently, in a typical asphalt plant, at least 30–45% of the heat energy supplied to the plant is wasted.

Reduction of dryer temperature is not a satisfactory solution to the problem of energy loss because it results in undesirable moisture condensation in dust collection equipment and also because it is less sufficient and requires a larger dryer to achieve the same results.

In the past, several systems have been proposed for the recovery of waste heat in asphalt plants. For example, it has been proposed to use exhaust heat to preheat the combustion air before it enters the dryer of a batch plant or the drying section of a drum mixer. Heat pipe systems, and heat exchangers, including rotary regenerative exchangers and cyclic pebble heaters have been proposed for this purpose. However, a problem in the preheating of combustion air is that it causes the air to expand. In order to introduce a given quantity of preheated air into a dryer or drying section, it is necessary either to increase the dryer inlet aperture or to increase the air velocity. Either of these modifications results in a highly undesirable increased production of noise. Furthermore systems for preheating combustion air are generally expensive in relation to the benefits they produce.

Another proposal for heat recovery is to recycle the exhaust gases through the dryer. The recycling of exhaust gases causes moisture to accumulate, and gives rise to various technical problems in devising systems to eliminate moisture.

Still another proposal is to use infrared radiant heating for aggregate drying in order to reduce the amount of gas released to the atmosphere. Infrared heating, however, is expensive to carry out in a large-scale asphalt plant.

Finally, proposals have been made for using hot dryer exhaust gases to preheat the aggregate. This is carried out by bringing the exhaust gases into direct contact with the aggregate in a preheating unit. This approach, however, requires the exhaust gases to be maintained substantially above the dew point as they pass through the aggregate preheating unit and through the necessary dust collection devices downstream of the preheating unit. Otherwise moisture from the exhaust gases would condense on the aggregate or in the dust collectors. Because it is necessary to maintain the exhaust gases well above the dew point in these systems, they are not very effective in recovering waste heat.

The principal object of this invention is to provide a simple and inexpensive system capable of producing effective heat recovery in an asphalt drying plant and which is not subject to the aforementioned drawbacks of the prior heat recovery proposals.

Up to the present time, the indirect heating of incoming aggregate by exhaust gases was considered inefficient and impractical by those skilled in the art. This invention, however, utilizes a specific system for the indirect heating of cold aggregate or cold used asphalt-aggregate compositions by utilizing exhaust gas heat derived from an aggregate dryer or from the drying section of a drum mixer.

In accordance with the invention, a duct is provided for conducting at least part of the exhaust gas from a dryer or drying section to the feed bins provided for temporarily storing virgin aggregate or to bins used for storing used asphalt-aggregate compositions prior to recycling. At least part of the wall of the duct is arranged to conduct heat from the exhaust gas to the solid material in the bins, while isolating the exhaust gas from the solid material to prevent moisture from the exhaust gas from condensing on the material.

In accordance with a preferred embodiment of the invention, the duct is split into a plurality of ducts which pass through a feed bin or a series of bins, and which are designed with vertically elongated transverse cross-sections to provide a large area in contact with the solid material in the bins for optimum transfer of heat. Internal and external fins are provided on the duct sections for still further improvements in heat transfer. These fins are arranged in such a way as not to impede flow of exhaust gas or aggregate.

Water injection is used at the upstream end of a series of bins to initiate condensation of the exhaust gas moisture for efficient heat transfer.

The system in accordance with the invention is extremely simple in construction, yet capable of recovering a substantial portion of the heat which would otherwise be lost to the atmosphere in a conventional asphalt plant.

Other objects, features and advantages of the invention will be apparent from the following detailed description when read in conjunction with the drawings.

DETAILED DESCRIPTION

Figure 1:
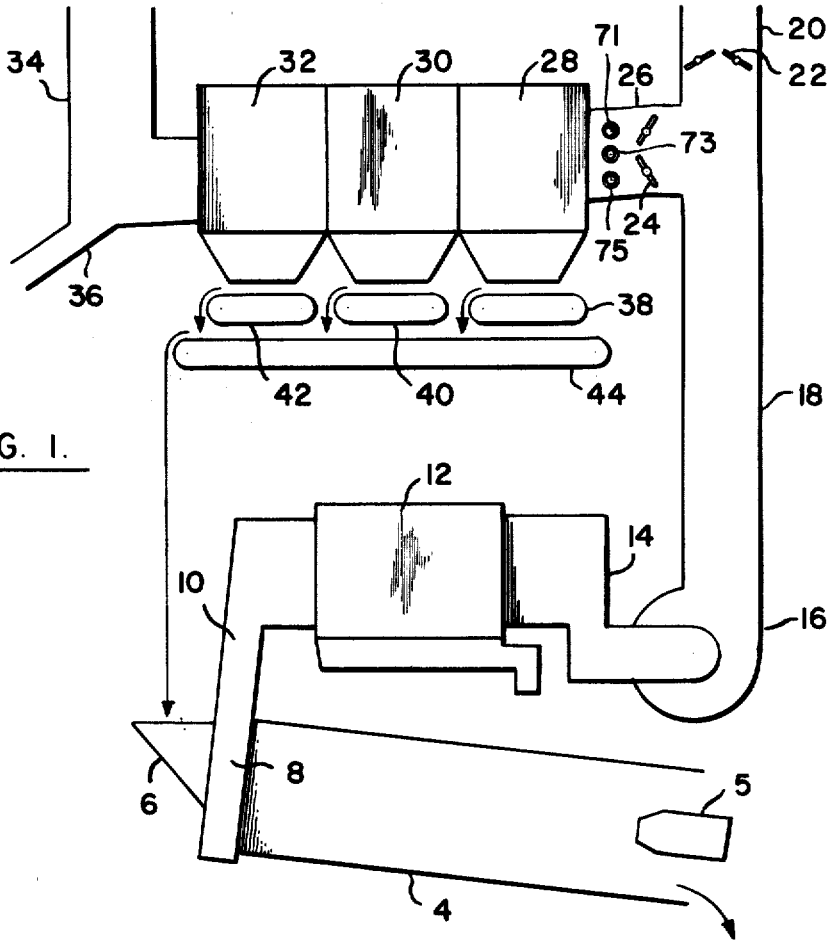
FIG. 1 is a schematic diagram of a part of a batch process asphalt mixing plant, showing a drum dryer, a group of aggregate feed bins, and showing the special exhaust duct in accordance with the invention.

In the preferred embodiment of the invention, as shown in FIG. 1, drying of aggregate takes place in a rotating drum dryer 4. The rotating drum is provided with a burner 5 at one end. The burner projects a flame axially into the interior of the drum. Aggregate is picked up by flights (not shown) on the interior wall of the drum, and a continuous shower of aggregate is maintained in the space within drum 4. Aggregate is received into the drum through a chute 6. The drum axis is slightly tilted with respect to the horizontal so that chute 6 is at the high end of the drum. Aggregate is discharged at the low end of the drum, and is from there transported to a pug mill (not shown) or other suitable mixing device where it is combined with asphalt cement to produce an asphaltic concrete.

An exhaust collection housing 8 is provided at the upper end of drum 4. This collection housing communicates through a duct section 10, a dust collector 12 and another duct section 14, with a blower 16. Blower 16 is arranged to draw exhaust gas from collection housing 8 through dust collector 12, and to deliver the exhaust gas to a duct section 18, which is in communication with an exhaust gas stack 20.

With blower 16 in operation, a stream of air is drawn into drum 4 at its lower end, and caused to pass through the drum in a direction opposite to the general direction of aggregate flow through the drum. Most of the dust produced in the drying operation in drum 4 is removed by dust collector 12, which is typically a bag house collector. Hot, substantially dust-free exhaust is delivered to the blower through dust collector outlet duct section 14, and is discharged into duct section 18.

The temperature of the exhaust discharged from the dryer into duct section 10 must be sufficiently high to avoid condensation in the dust collector. This is particularly important where the dust collector is a bag house, as the condensation of moisture on the filter elements would seriously interfere with the proper operation of the plant. The need to maintain high temperature at the location of the dust collector, however, would result in an excessive loss of heat to the atmosphere if the exhaust were merely discharged through exhaust stack 20.

In accordance with the invention, dampers 22 and 24 are provided in order to divert exhaust into duct section 26, which extends serially through aggregate cold feed bins 28, 30 and 32, and leads to an exhaust stack 34. Duct section 26 preferably slopes downwardly in the direction of exhaust flow to avoid accumulation of condensed water. A condensate outlet is provided at 36. Feed bins 28, 30 and 32 are provided respectively with belt feeders 38, 40 and 42, which are selectively operable to discharge aggregate from the bins onto a conveyor 44. Aggregate is discharged from conveyor 44 into chute 6 of dryer 4.

At least part of the wall of duct section 26 is in contact with the aggregate in bins 28, 30 and 32. A direct transfer of heat takes place through the wall of duct section 26 from the exhaust gas to the aggregate in the bins. The aggregate is heated, and gives up part of its moisture in the form of water vapor inside the bins, and also while it is travelling over the feeders and over conveyor 44 toward chute 6. Within conduit 26, exhaust water vapor is condensed, and the moisture flows downwardly and is discharged through outlet 36. A substantial portion of the exhaust heat is thus recovered, and used to preheat the aggregate, and eliminate part of its moisture content. Since the aggregate entering the dryer through chute 6 is preheated, and contains less moisture than the aggregate in the cold feed bins, a fuel saving is realized at the burner. While less fuel is used at the burner, the exhaust is maintained at a sufficiently high temperature to avoid condensation in the dust collector.

In the operation of the system of FIG. 1, as feeding of aggregate takes place, there is a constant turnover of the aggregate within at least one of the bins. New aggregate surfaces are continuously being presented to the portions of the walls of duct section 26 which are in contact with the aggregate. Thus, at any given time, the temperature differential between the duct walls and the aggregate surfaces is such as to promote heating of the aggregate in the bin or bins from which aggregate is being fed. Most aggregates are relatively non-porous. Most of the water is carried on the surfaces of the stones and is readily evaporated as a result of the heating of the surfaces by contact with the exhaust duct walls.

If any bin is full of aggregate, but its feeder is not operating, the temperature of the aggregate within that bin in contact with duct section 26 rises, but the rise in temperature limits the flow of heat into the inoperative bin. Consequently, most of the available heat in duct section 26 is transferred to the aggregate in the operating bin or bins. To avoid loss of heat to the atmosphere through the portion of duct section 26 which procedes the bins, and through duct section 18, suitable insulation may be provided. The bins, while shown arranged in a line and in contact with each other, may be arranged in any suitable configuration. If they are separate from each other, it is desirable to insulate portions of duct 26 which extend between the bins.

Figure 2:
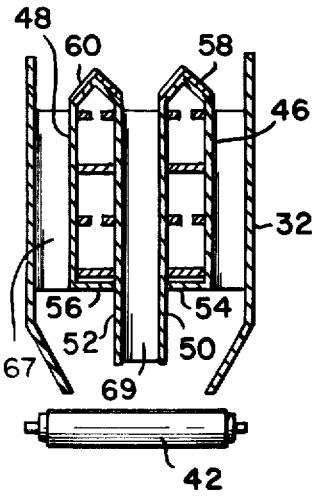
FIG. 2 is a vertical section taken through a feed bin of FIG. 1, showing plural exhaust ducts in transverse cross-section.
Figure 3:
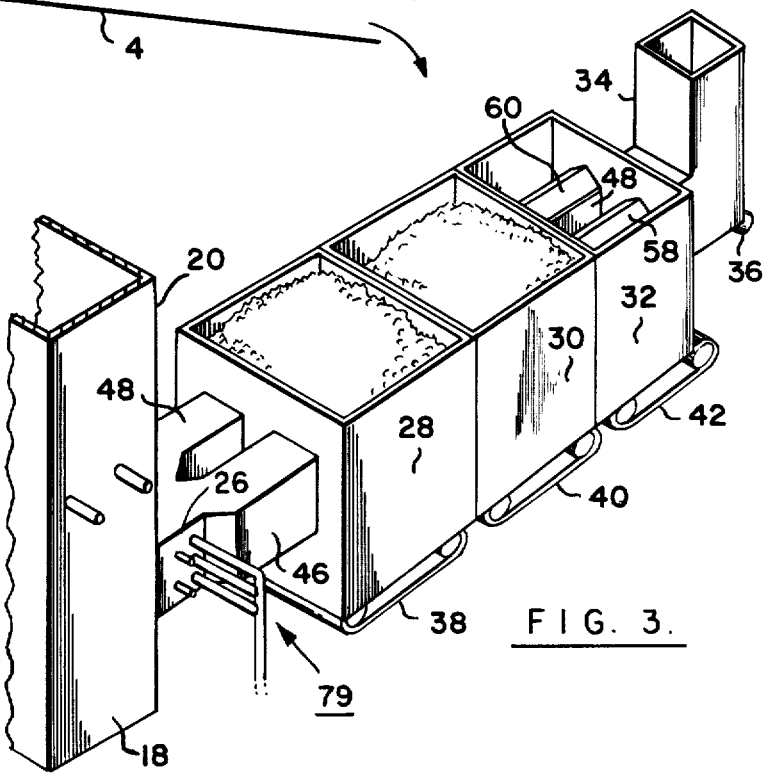
FIG. 3 is an oblique perspective view showing further details of the relationship between the feed bins and the exhaust ducts.

FIGS. 2 and 3 show the details of the configuration of duct 26. As shown in FIG. 3, duct section 26 is bifurcated so that it extends through the series of bins in two sections, 46 and 48. Beyond bin 32, sections 46 and 48 are rejoined as they enter exhaust stack 34.

As shown in FIG. 2, duct sections 46 and 48 are vertically elongated. That is, the vertical height of each side wall of each duct section is greater than the width of the duct section. Preferably, the side wall height is at least twice the duct section width. The vertically elongated configuration of the duct sections provides a large area of contact between the duct sections and the aggregate within the bins.

The advantage of vertical elongation is not only in the resulting increase in the surface area presented to the aggregate in the bin, but also in the fact that, for a given duct cross-section, the vertically elongated configuration minimizes the downwardly facing horizontal surface area (e.g. surfaces 54 and 56) which is substantially less effective for heat transfer purposes than the vertical surfaces of the duct sections. This is because gaps may appear underneath the downwardly facing surfaces as aggregate is discharged from the bin. Gaps are particularly likely to occur with downwardly facing surfaces of large area. The vertically elongated configuration of the duct sections within the bins also prevents the duct sections from occupying an excessive volume within the bins and from materially interfering with the flow of aggregate through the bins.

The facing walls of the duct sections are extended at 50 and 52, as shown in FIG. 2, to provide fins for further contact area. Fins, corresponding to fins 50 and 52, on a wide, vertically short duct would interfere with aggregate flow and would not be effective to increase the heat transfer contact area. However, since duct sections 46 and 48 are vertically elongated, fins such as 50 and 52 can be used much more effectively to increase the available heat transfer contact area.

Figure 4:
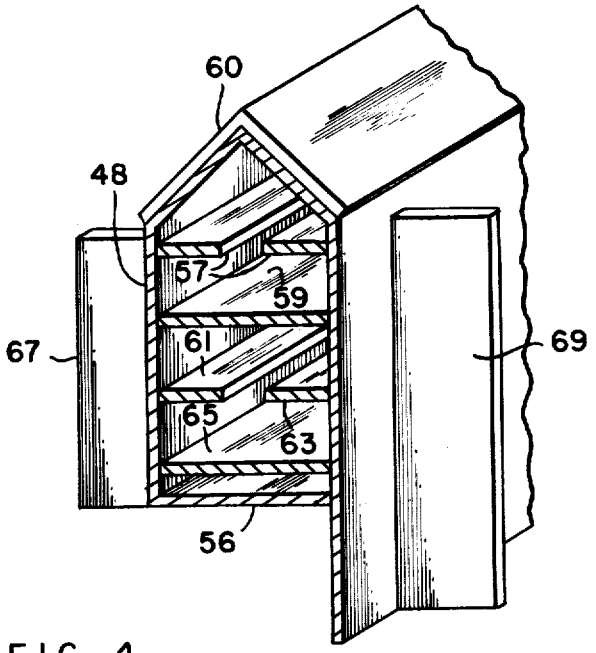
FIG. 4 is an oblique perspective view, in transverse section, of an exhaust duct, showing interior and exterior heat transfer fins.

As shown in FIG. 4, an array of fins 57, 59, 61, 63 and 65 is provided in the interior of duct section 48 to improve the transfer of heat to the exterior walls of the duct section. Duct section 46 has a similar array of internal fins. These fins are preferably flat, elongated fins and extend generally in the direction of exhaust flow.

Duct section 48 also has flat, external fins extending in perpendicular relationship to its side walls. The large surfaces of these fins are preferably substantially vertical. Two such fins are shown in FIG. 4 at 67 and 69. These fins provide an increased area in contact with the aggregate in the bins, without interfering with the downward flow of aggregate through the bins. Duct section 46 has similar external fins, and as shown in FIG. 2, fin 69 is common to both duct sections.

The walls of duct sections 46 and 48 are typically of ¼ inch steel plate. Because the bins are repeatedly loaded with aggregate, considerable wear occurs, particularly at the tops of the duct sections. Accordingly, in order to minimize the need for duct replacement, the duct sections, as shown in FIGS. 2 and 3, are provided with replaceable caps 58 and 60, which are bolted to otherwise suitably secured in place. Most of the wear resulting from the dropping of aggregate into the bins takes place on these caps. However, they can be replaced much more readily than the duct sections.

The protective caps preferably extend substantially from one end wall to the opposite end wall in each bin. They are preferably of an exteriorly peaked shape to prevent aggregate from accumulating. Desirably the tops of duct sections 46 and 48 are also peaked and conform to the undersides of the caps so that heat transfer can take place through the caps when the bins are full of aggregate.

The positions and configurations of duct sections 46 and 48 are such that when bin 32 is full, the duct sections are substantially completely surrounded by aggregate in the transverse plane on which FIG. 2 is taken. Because the duct sections are substantially completely surrounded, a highly effective transfer of heat takes place from the exhaust gases within the duct sections to the aggregate within the bin.

Figure 5:
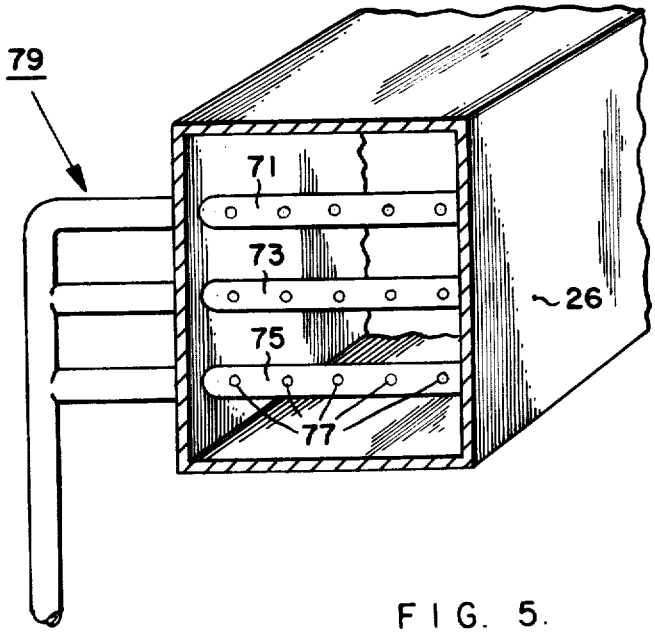
FIG. 5 is an oblique perspective view, in transverse section, of an exhaust duct section showing an arrangement of water injection nozzles.

For still further improvement of heat transfer, water spray bars 71, 73 and 75 are provided in the interior of duct section 26, as shown in FIG. 5. Each bar has a series of nozzles arranged to spray water in the direction of exhaust flow. Bar 75, for example has a series of five nozzles 77. Water is supplied through a manifold 79.

The introduction of a spray of water at a location near where the exhaust duct sections enter the first bin causes condensation to begin near that location rather than at some intermediate location between the first and last bin. This contributes to the maximization of heat transfer by causing the moisture content of the exhaust gases to give up its latent heat of vaporization while the exhaust gases are passing through the bins rather than after they are exhausted to the atmosphere. The effectiveness of heat transfer can be improved by controlling the rate of water introduction while measuring bin and exhaust gas temperatures.

In the operation of the system just described, dampers 22 and 24 can be adjusted to divert any desired proportion of the exhaust gas from duct section 18 into duct section 26. As the exhaust passes through the duct sections within the bins, it is cooled by the surrounding aggregate, and water vapor in the exhaust condenses. The condensation process continues throughout the lengths of duct sections 46 and 48 within the confines of the feed bins. A relatively constant exhaust temperature and duct section temperature of about 200° F. is maintained throughout the length of duct sections 46 and 48.

The condensate flows downwardly through the duct sections which extend through the feed bins, and flows out through outlet 36. Exhaust gas passes upwardly through exhaust stack 34.

The interior of duct sections 46 and 48 may be protected by inert lining materials or coatings to minimize corrosion. For example, liners of silicone rubber or other suitable plastic materials can be applied by spraying. Alternatively, various coatings such as epoxy paints can be used.

Various modifications can be made to the system just described. For example, while duct section 26 is bifurcated into sections 46 and 48 in the particular embodiment shown, it can be split into as many duct sections as desired to increase the duct wall area available for transfer of heat from the exhaust to the aggregate.

In another modification, the walls of the feed bins themselves can be used to transfer heat from the exhaust gases to the aggregate by providing the bins with suitable exhaust-conducting jackets.

Of course, the invention is applicable wherever aggregate is dried and heated in an asphalt plant. Thus, for example, the heating of aggregate can be carried out by feeding the exhaust from a drum mixer through the aggregate feed bins in a manner similar to that here described.

Finally, the exhaust of a drying drum or of a drum mixer can be used to preheat used asphaltic concrete before it is recycled into the asphalt-aggregate mixture. This is accomplished by feeding the dryer exhaust through or around the used asphaltic concrete feed bins in a manner similar to that specifically described above with reference to the preheating of virgin aggregate.

Various other modifications can be made to the apparatus and method specifically described herein without departing from the scope of the invention as defined in the following claims.

I claim:

1. In an asphalt mixing plant comprising:

feed bin means for receiving solid material from the group consisting of virgin aggregate and used asphalt-aggregate compositions at substantially ambient temperatures and for temporarily containing said material prior to delivery to a drying device;

drying means for temporarily containing aggregate including means for showering the aggregate through a moving air stream;

burner means for directly supplying heat to the aggregate and the moving air stream in the drying means; and means for effecting a flow of exhaust gas out of the drying means to carry away moisture from the drying means;

wherein the improvement comprises duct means for conducting at least part of the exhaust gas from the drying means to said feed bin means, at least part of the wall of said duct means serving to conduct heat from said exhaust gas to the solid material in said feed bin means while isolating said exhaust gas from said material to prevent moisture from said exhaust gas from condensing on said material, and means for initiating condensation of moisture from said exhaust gas substantially adjacent to but upstream of the location where the exhaust gas within the duct means first reaches the location at which said part of the wall of said duct means conducts heat from said exhaust gas to said solid material.

2. An asphalt mixing plant according to claim 1 in which said duct means comprises at least one duct extending through said feed bin means and positioned within said feed bin means so that it can be substantially completely surrounded by solid material contained in said feed bin means.

3. An asphalt mixing plant according to claim 1 in which said duct means comprises at least one duct extending through said feed bin means and positioned within said feed bin means so that it can be substantially completely surrounded by solid material contained in said feed bin means, said duct having a vertically elongated transverse cross-sectional shape.

4. An asphalt mixing plant according to claim 1 in which said duct means comprises at least one duct extending through said feed bin means and positioned within said feed bin means so that it can be substantially completely surrounded by solid material contained in said feed bin means, and having replaceable cap means located on top of said duct for preventing damage to said duct by material dropping into said feed bin means.

5. An asphalt mixing plant according to claim 1 in which said duct means comprises at least one duct extending through said feed bin means and positioned within said feed bin means so that it can be substantially completely surrounded by solid material contained in said feed bin means, and having replaceable cap means located on top of said duct for preventing damage to said duct by material dropping into said feed bin means, said cap means having an exteriorly peaked slope in cross-sections transverse to the direction of exhaust flow through said duct.

6. An asphalt mixing plant according to claim 1 in which said duct means comprises at least one duct extending through said feed bin means and positioned within said feed bin means so that it can be substantially completely surrounded by solid material contained in said feed bin means, said duct having a peaked transverse cross-sectional shape, and having replaceable cap means located on top of said duct for preventing damage to said duct by material dropping into said feed bin means, said cap means having a peaked transverse cross-sectional shape conforming to the shape of the top of the duct.

7. An asphalt mixing plant according to claim 1 in which said duct means comprises a plurality of separate ducts extending through said feed bin means, each of said separate ducts being positioned within said feed bin means so that it can be substantially completely surrounded by solid material contained in said feed bin means.

8. An asphalt mixing plant according to claim 1 in which said duct means is arranged to conduct said exhaust gas to the surrounding atmosphere.

9. An asphalt mixing plant according to claim 1 in which said duct means comprises dust collection means located in the path of exhaust gas flow from the drying means to the feed bin means.

10. An asphalt mixing plant according to claim 1 in which said duct means comprises a dust collecting bag house located in the path of exhaust gas flow from the drying means to the feed bin means and in which said means for supplying heat to the aggregate in the drying means is sufficient to prevent condensation of moisture from taking place in said dust collecting bag house.

11. An asphalt mixing plant according to claim 1 in which said feed bin means comprises a plurality of individual feed bins, and in which said duct means comprises at least one duct extending serially through all of said feed bins.

12. An asphalt mixing plant according to claim 1 in which said duct means comprises at least one duct extending through said feed bin means and positioned within said feed bin means so that it can be substantially completely surrounded by solid material contained in said feed bin means, said duct having a vertically elongated transverse cross-sectional shape, and also having depending fin means for conducting heat to the solid material in said feed bin means.

13. An asphalt mixing plant according to claim 1 in which said duct means has an outlet for condensed moisture.

14. An asphalt mixing plant according to claim 1 in which said duct means has an outlet for condensed moisture, and in which said duct means is arranged with at least its lower wall sloping downwardly toward said outlet from the location at which said duct means enters said feed bin means whereby condensed moisture is conducted by gravity to said moisture outlet.

15. An asphalt mixing plant according to claim 1 having means for conducting at least part of the exhaust gas from said drying means directly to the surronding atmosphere without passing through said feed bin means, and also having damper means for controlling the proportion of said exhaust gas conducted by said duct means to said feed bin means.

16. An asphalt mixing plant according to claim 1 having fin means, extending inwardly from said part of the wall of said duct means, for effecting transfer of heat from the exhaust gas to said part of the wall of said duct means.

17. An asphalt mixing plant according to claim 1 having fin means, extending inwardly from part of the wall of said duct means, for effecting transfer of heat from the exhaust gas to said part of the wall of said duct means, said fin means comprising a plurality of substantially flat fins, the surfaces of which extend substantially in the direction of exhaust gas flow in said duct means.

18. An asphalt mixing plant according to claim 1 having fin means, extending inwardly from said part of the wall of said duct means, for effecting transfer of heat from the exhaust gas to said part of the wall of said duct means, said fin means comprising a plurality of substantially flat elongated fins, the surfaces of which extend substantially in the direction of exhaust gas flow in said duct means.

19. An asphalt mixing plant according to claim 1 having fin means extending horizontally outwardly from said part of the wall of said duct means into the interior of said feed bin means.

20. An asphalt mixing plant according to claim 1 having fin means extending horizontally outwardly from said part of the wall of siad duct means into the interior of said feed bin means, said fin means comprising a plurality of substantially flat fins the large surfaces of which extend generally vertically within the interior of said bin means.

21. An asphalt mixing plant according to claim 1 having means for injecting a spray of water into said duct means adjacent the location at which the exhaust gas in said duct means first comes into close proximity to the solid material in said feed bin means.

22. A method for preparing asphaltic concrete comprising the steps of supplying heat to a quantity of aggregate, effecting a flow of exhaust gas to carry moisture away from said aggregate through a duct, and conducting heat from said exhaust gas to a solid ingredient of asphaltic concrete, while said ingredient is physically separated from said aggregate, through a solid, heat-conductive, wall of said duct in contact with said ingredient, while condensing moisture within said duct, and isolating said condensed moisture from said solid ingredient, said method including the step of initiating condensation of the water vapor in said exhaust gas in said duct at a location substantially adjacent to but upstream of the location at which the exhaust gas within said duct first comes into close proximity to said solid ingredient.

23. A method for preparing asphaltic concrete comprising the steps of supplying heat to a quantity of aggregate, effecting a flow of exhaust gas to carry moisture away from said aggregate through a duct, and conducting heat from said exhaust gas to a solid ingredient of asphaltic concrete, while said ingredient is physically separated from said aggregate, through a solid, heat-conductive, wall of said duct in contact with said ingredient, while condensing moisture within said duct, and isolating said condensed moisture from said solid ingredient, said method including the step of spraying water into the interior of said duct at a location adjacent the location at which the exhaust gas within said duct first comes into close proximity to said solid ingredient, thereby initiating condensation of the water vapor in said exhaust gas.

* * * * *